US005271194A

United States Patent [19]

Drew

[11] Patent Number: 5,271,194

[45] Date of Patent: Dec. 21, 1993

[54] MECHANISM FOR PREVENTING SNOW FROM SLIDING OFF ROOFS

[76] Inventor: Donald A. Drew, 12957 Ellicott Hwy. Rte. 3, Calhan, Colo. 80808

[21] Appl. No.: 895,897

[22] Filed: Jun. 9, 1992

[51] Int. Cl.[5] ..... E04D 13/10

[52] U.S. Cl. ..... 52/25; 52/127.2; 52/697; 248/231.7

[58] Field of Search ..... 52/24, 25, 127.2, 697; 248/231.7, 316.1; 256/DIG. 6

[56] References Cited

U.S. PATENT DOCUMENTS

| | | | |
|---|---|---|---|
| 507,776 | 10/1893 | Berger et al. . | |
| 579,735 | 3/1897 | Bower | 248/231.7 |
| 1,054,091 | 2/1913 | Darnall | 52/25 |
| 1,330,309 | 2/1920 | Dixon | 52/24 |
| 2,201,320 | 5/1940 | Place . | |
| 2,890,845 | 6/1959 | Kiekhaefer | 248/231.7 |
| 4,903,929 | 2/1990 | Hoffman | 248/231.7 |

FOREIGN PATENT DOCUMENTS

| | | | |
|---|---|---|---|
| 222329 | 7/1962 | Austria . | |
| 2126082 | 12/1972 | Fed. Rep. of Germany . | |
| 2523087 | 11/1976 | Fed. Rep. of Germany . | |
| 2845103 | 4/1980 | Fed. Rep. of Germany . | |
| 2845104 | 4/1980 | Fed. Rep. of Germany . | |
| 3716491 | 12/1988 | Fed. Rep. of Germany . | |
| 3723020 | 1/1989 | Fed. Rep. of Germany | 52/24 |
| 204783 | 8/1939 | Switzerland . | |

*Primary Examiner*—Carl D. Friedman
*Assistant Examiner*—Christopher Kent
*Attorney, Agent, or Firm*—Linda Flewellen Gould

[57] ABSTRACT

Snow accumulating on sheet metal roofs may fall in large masses, causing damage to property and persons in its path. A method of impeding snow from sliding off metal roofs is provided. The method involves installing a series of attachment mechanisms which are generally U-shaped, so that each attachment mechanism straddles a roof seam. Each attachment mechanism is secured by screwing a blunt edged screw into a hole in a prong of that attachment mechanism to tighten that mechanism against the roof seam, without penetrating the seam. Each attachment mechanism is provided with a bar receiving channel to hold a bar perpendicular to the seams, to prevent large masses of snow from sliding off the roof.

3 Claims, 2 Drawing Sheets

MECHANISM FOR PREVENTING SNOW FROM SLIDING OFF ROOFS

BACKGROUND OF THE INVENTION

1. Technical Field

This invention pertains to a method and device for preventing sheets of snow from sliding off roofs where that snow has accumulated.

2. Background Art

In climates experiencing snow and prolonged cold weather, snow accumulating on roofs can become a safety hazard. After snow has fallen onto a roof, it may remain in place for an indeterminate period of time. Eventually, as the snow melts, large sheets of snow may break off from the accumulated snow. If the roof on which the snow has accumulated is sloped, such sheets may suddenly fall off the roof onto unsuspecting individuals or property. The weight of such snow sheets is frequently so significant as to cause injury to individuals and serious damage to property.

The hazard caused by accumulated snow may be particularly dangerous when that snow is found on a sheet metal roof. These roofs provide a slippery surface which facilitates sliding of sheets of snow.

A variety of devices for preventing snow from falling from particular types of roofs are known in the prior art. West German Patent 2126082, West German Patent 2523087, Austrian Patent 222329, and Switzerland patent 204783 each teach a type of snow blocking device involving an elongated member which is held above the roof. In each of these patents, the elongated member is held in place by two parallel plates which are secured to each other positioned on either side of a roof seam. Such mechanisms can be useful for particular roof designs in which the roof seams may be snugly fit in between two parallel plates. However, such mechanisms are not easily adapted to fit roof seams of a size or configuration different than the one for which each is designed.

U.S. Pat. No. 2,201,320 to Place teaches the use of multiple sheet metal strips with bent ends to hook over roof seams. Such snow guards may be effective, but must be manufactured to fit the exact distance between adjacent roof seams.

Brackets attached to roof seams to support elongated supports used as scaffolds are described in U.S. Pat. No. 1,054,091 to Darnall. Arguably, another purpose to be served by the Darnall mechanism would be to prevent masses of snow from falling from a roof. Each bracket includes a cam lever which engages a roof seam to attach the bracket to the seam.

Three West German patents, 2845104, 2845103, and 3716491, reveal various mechanisms used to trap snow on a roof. These patents rely on a plurality of snow retainers, each independently attached to a roof seam. In some cases, the retainer appears to be attached to the seam by means of a screw which penetrates the seam, thus possibly lessening the structural integrity of the seam and inviting leaks in the roof. Similarly, the snow guard in U.S. Pat. No. 507,776 to Berger et al. has teeth or projections which pierce the roof seam with possible detrimental results.

While each of these mechanisms known in the prior art is useful for its intended purpose, no mechanism is known which may be easily installed to prevent large masses of snow from falling from a metal roof with standing seams. There exists a need for a mechanism which can be simply secured onto metal roofs of a variety of shapes and sizes, which will decrease the hazard created by sliding snow masses.

DISCLOSURE OF THE INVENTION

Summary of the Invention

An object of this invention is to provide a method of preventing masses of snow from sliding off a sheet metal roof with standing seams.

Another object of this invention is to provide a device for preventing such falling of snow which can be easily installed onto a large variety of roofs with seams of different sizes, shapes, and configurations.

Yet another object of this invention is to provide such a device for preventing such falling of snow which can be secured to a sheet metal roof without piercing the roof or roof seams.

The device used in this method of preventing sheets of snow from falling from sheet metal roofs comprises a plurality of attachment mechanisms, each capable of supporting a bar which extends perpendicular to the roof seams. The attachment mechanisms are generally U-shaped, with two prongs and an apex. Thus, the attachment mechanisms may fit around a variety of different widths of roof seams. Furthermore, the attachment mechanisms will conveniently fit around roof seams which are broader at one point than another, such as a seam that is broader at the top than at the point of connection to the roof.

To facilitate securing the attachment mechanisms to roof seams, a hole is provided in one or both prongs of each attachment mechanism, for receiving an attachment screw. The attachment screw has a blunt tip which will not penetrate the roof seam as the attachment screw is tightened to hold the attachment mechanism in place next to the roof seam.

The instant method of preventing large sheets of snow from falling off roofs involves attaching a plurality of attachment mechanisms to roof seams. It is not essential that every roof seam be fitted with an attachment mechanism, as long as sufficient attachment mechanisms are connected to roof seams to provide support for the bar to be held in place by the attachment mechanisms. The attachment mechanisms should be aligned so that the bar may be placed adjacent to the apex of each attachment mechanism. The next step in this method is to connect the bar to the attachment mechanisms. This may be accomplished by screwing, welding, or otherwise connecting the bar directly to the apex of each attachment mechanism, holding the bar essentially perpendicular to the roof seams and adjacent to said apexes while the connections are being made.

A more convenient method of connecting the attachment mechanisms to the bar may be utilized. In this method, each attachment mechanism is provided with a bar receiving channel, connected to the apex of the attachment mechanism prior to connecting the attachment mechanisms to the roof seams. The channel is designed to snugly receive the bar, so that the bar may be placed into a plurality of channels to hold the bar in its desired position with respect to the roof. Thus, once the attachment mechanisms are attached to the roof seams, the bar may be placed into the channels which hold the bar in place.

To further secure the bar in its desired location, a securing screw may be inserted through one or more of the channels into the bar. A hole may be provided in each channel to facilitate placement of the securing screw. The securing screw may be inserted through the channel opposite the connection of the channel to the apex of the U-shaped attachment mechanism. Alternatively, if more convenient, the securing screw may be inserted through the apex of the U-shaped attachment mechanism, through the channel at its point of connection to that apex, and into the bar.

Use of attachment mechanisms with bar receiving channels facilitates installation of this device for preventing sheets of snow from falling in a number of ways. Even when roof seams are spaced with differing distances between adjacent seams, use of separate attachment mechanisms enables the mechanisms to be quickly installed without modification. Then, the bar may be conveniently placed in the channels of each attachment mechanism, again with no modification required to adjust for differing distances between adjacent roof seams. Similarly, the bar may be easily placed into the channels without regard for the size or shape of each individual seam, differences in which are accommodated by placing each U-shaped attachment mechanism over the seam with a prong on either side of the seam.

Another advantage of the instant invention is that the bar may be easily removed from the attachment mechanisms. If a significant build-up of snow occurs, it may be desirable to push that snow off the roof at a time when the area beneath the roof can be cleared of anyone or anything that might be hurt by the snow. The bar can be removed at such a time, the snow pushed off the roof, and the bar easily reinserted into the channels of the attachment mechanism.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

Figure 1:
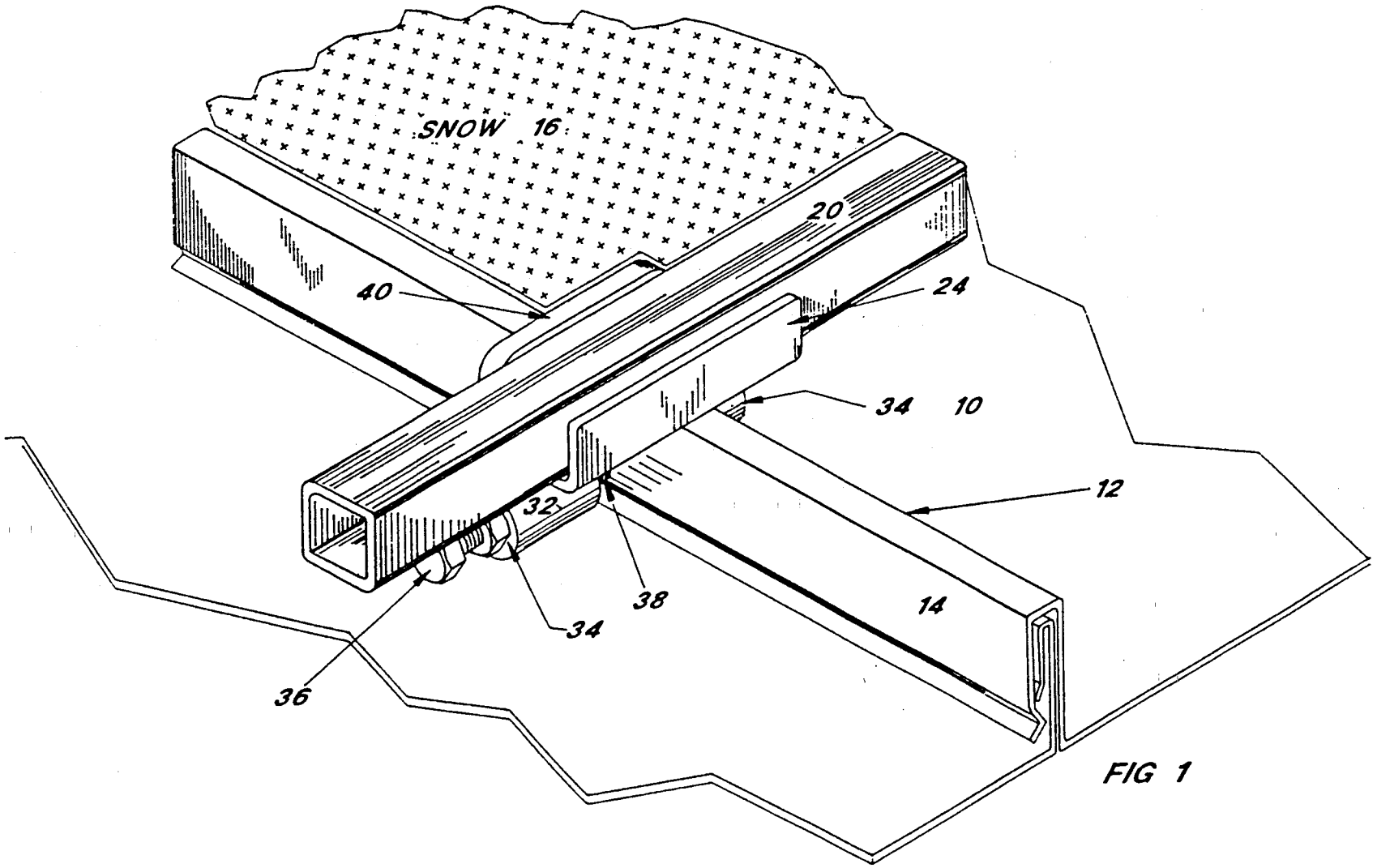
FIG. 1 is a perspective view of an attachment mechanism attached to a roof seam used in this method of preventing snow from falling from a sheet metal roof.

The method of preventing sheets of snow or ice from falling off a sheet metal roof with standing roof seams according to the present invention can be better understood by reference to FIG. 1. A sheet metal roof 10 contains a plurality of standing seams or ribs 12, each of which has two sides 14. Each seam 12 extends upward from and generally perpendicular to the roof 10. The roof seams 12 on any roof 10 are typically of a similar shape and size. However, the size and shape of seams 12 in one roof 10 may be very different from the size and shape of seams 12 in another roof 10. Thus, it is advantageous to anticipate a variety of shapes and sizes of seams 12. Furthermore, it is possible that the distance between adjacent seams 12 may vary, and this variation should also be accommodated.

When snow accumulates on a sheet metal roof 10, a potentially dangerous situation develops. As the snow melts and re-freezes, large masses of the resulting snow and ice 16 may become dislodged and slide toward the ground (not shown). The movement of such snow 16 toward the ground may be effectively impeded by a bar 20 held in place by a plurality of attachment mechanisms 22. Each attachment mechanism 22 is secured to a roof seam 12.

Figure 2:
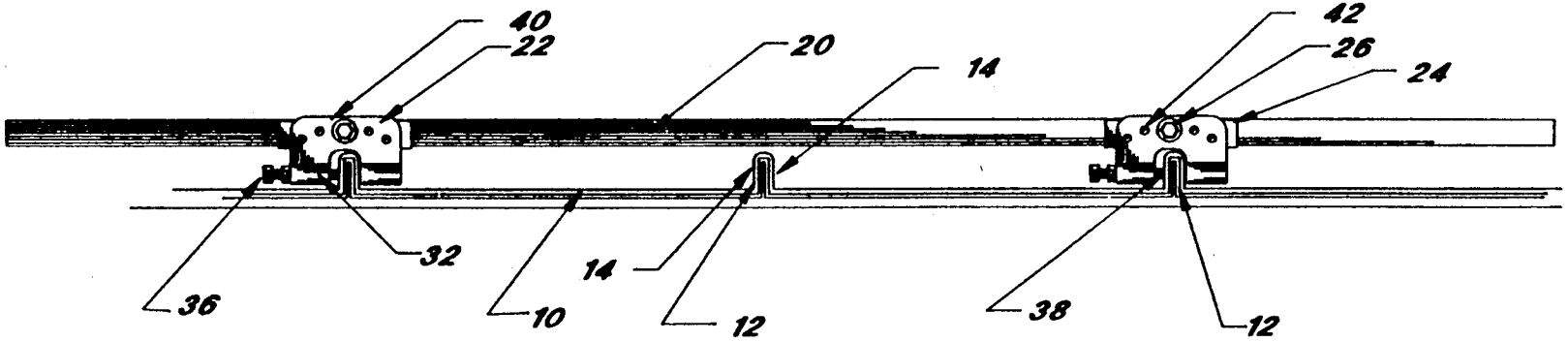
FIG. 2 is a front view of a plurality of attachment mechanisms attached to roof seams according to the present invention.

To facilitate each attachment mechanism 22 fitting around roof seams 12 of a variety of shapes and sizes, the attachment mechanisms 22 can be generally formed in a U-shape, with two prongs 32 and an apex 40. As can be seen in FIG. 2, the prongs 32 of each attachment mechanism 22 can be placed on either side 14 of the roof seam 12 to which that attachment mechanism 22 is to be secured.

Figure 4:
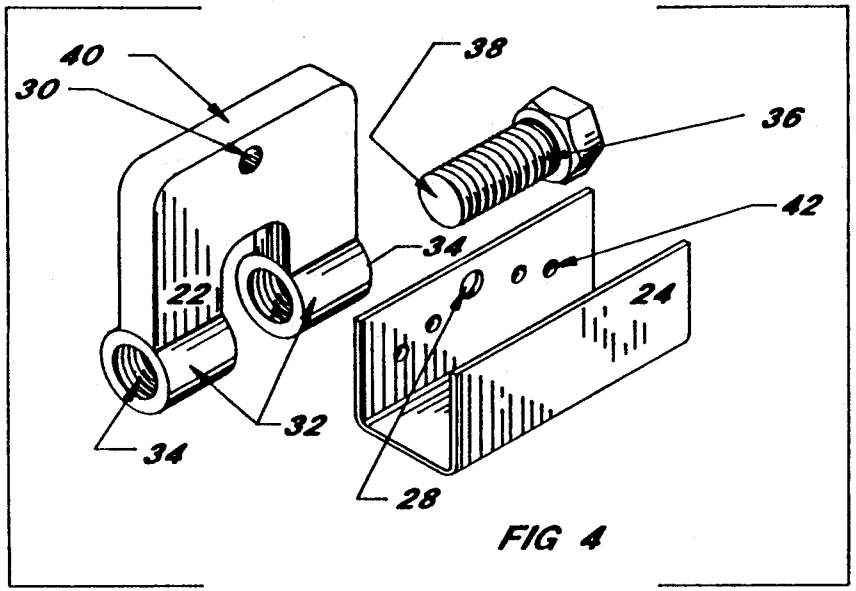
FIG. 4 is an exploded view of an attachment mechanism according to the present invention.

Each attachment mechanism 22 can be easily secured to a roof seam 12 by screwing an attachment screw 36 through a hole 34 formed in one prong 32 of the attachment mechanism 22. As is best shown by FIG. 4, a hole 34 may be provided in each of the prongs 32 of each attachment mechanism 22. Although the attachment mechanism 22 may be firmly connected to a roof seam 12 by means of an attachment screw 36 inserted into just one prong 32 of the attachment mechanism 22, providing a screw receiving hole 34 in each prong 32 facilitates installation by allowing the attachment screw 36 to be screwed into whichever prong 32 is more convenient.

The attachment screw 36 is provided with a blunt tip 38, as is best shown in FIG. 4. Thus, the attachment screw 36 may be tightened against the roof seam 12, to securely hold the attachment mechanism 22 around the roof seam 12, without penetrating the roof seam 12.

The method claimed herein of preventing sheets of snow 16 from falling from metal roofs 10 may be conveniently preceded by using a chalk line (not shown) or other means of marking a straight line to delineate a straight line across multiple roof seams 12, generally parallel to the edge of the roof 10 over which snow 16 might fall. A plurality of attachment mechanisms 22 may then be simply attached to roof seams 12 so that said attachment mechanisms 22 are parallel to each other, following said straight line.

Figure 3:
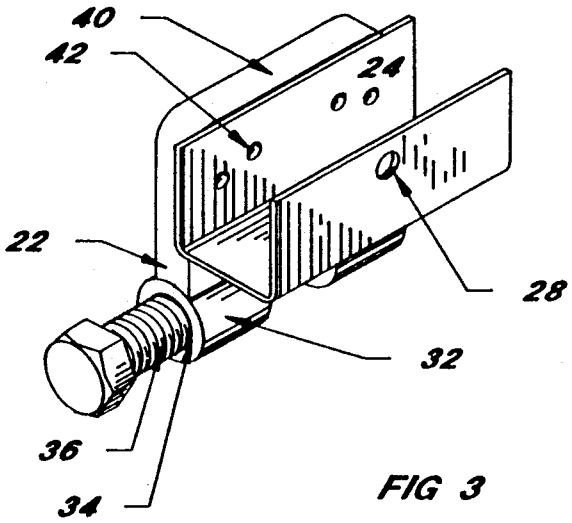
FIG. 3 is a perspective view of an attachment mechanism according to the present invention.

Next, the bar 20 is connected to each attachment mechanism 22. Many different methods of connecting the bar 20 to the attachment mechanisms 22 are possible. In the preferred embodiment shown in FIG. 3, each attachment mechanism 22 is provided with a bar receiving channel 24, attached to the apex 40 of the attachment mechanism 22. If each bar receiving channel 24 is attached to each attachment mechanism 22 prior to installing the attachment mechanisms 22 on the roof seams 12, the bar 20 may then be easily fit into the channels 24 as soon as the attachment mechanisms 22 have been secured to the roof seams 12. Each channel 24 may be simply secured to the apex 40 of an attachment mechanism 22 by a series of spot welds 42, as shown in FIG. 3, or by screws or other commonly available connecting method.

The channels 24 are aligned so that a bar 20 placed into each of the channels 24 will be held in a position advantageous to impede falling snow 16 when the attachment mechanisms 22 are secured to roof seams 12.

Thus, when the bar 20 is placed into the channels 24, it will rest parallel to a straight line (not shown) which may be marked onto the roof 10 to facilitate installation.

The bar 20 may be further secured in its desired location by inserting a series of securing screws 26 into one or more of the channels 24 and tightening those securing screws 26 into the bar 20. A hole 28 shown in FIG. 3 may be beneficially provided to accommodate entry of the securing screw 26 through the channel 24 into the bar 20. Alternatively, a hole 28 as shown in FIG. 4 may be provided in the channel 24 adjacent to a hole 30 in the apex 40 of the attachment mechanism 22 so that the securing screw 26 may be inserted through said apex 40, into the channel 24, and into the bar 20.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A mechanism to prevent snow or ice from sliding off a sheet metal roof with a plurality of standing roof seams, wherein each roof seam has two sides, comprising:

a. a plurality of attachment mechanisms, each generally U-shaped having two prongs and an apex, each attachment mechanism being capable of being secured to one of said roof seams with one of said prongs adjacent to each side of the roof seam, without penetrating the roof seam, b. a bar extending parallel to an apex of one of said attachment mechanisms, c. a plurality of bar receiving channels, each one of said bar receiving channels being attached to an apex of one of said attachment mechanisms, each bar receiving channel shaped and aligned to snugly receive said bar, d. a channel hole formed in at least one of said bar receiving channels to receive a securing screw, and e. a securing screw inserted in said channel hole and tightened into said bar to secure said bar within said channel, f. wherein each channel hole is aligned with an apex hole formed in an apex of an attachment mechanism, so that said securing screw is inserted through said apex hole and through said channel hole, securing said apex to said bar receiving channel and to said bar.

2. A mechanism as described in claim 1, each attachment mechanism further comprising:

a. a screw receiving hole formed in at least one of said prongs, said hole aligned to receive a screw inserted generally parallel to said bar, and b.an attachment screw inserted into said hole so that said attachment screw is adapted to be held securely against the roof seam to be secured to said attachment mechanism.

3. A mechanism as described in claim 2, wherein said attachment screw has a blunt tip, in which said blunt tip is adapted to not penetrate the roof seam against which said attachment screw is adapted to be securely held.

* * * * *